US010948234B1

(12) United States Patent
Jorjadze et al.

(10) Patent No.: US 10,948,234 B1
(45) Date of Patent: Mar. 16, 2021

(54) SYSTEM AND METHOD FOR HEATING MATERIALS

(71) Applicants: Vasily Jorjadze, Shoreham, NY (US); David Gelenidze, Tbilisi (GE)

(72) Inventors: Vasily Jorjadze, Shoreham, NY (US); David Gelenidze, Tbilisi (GE)

( * ) Notice: Subject to any disclaimer, the term of this patent is extended or adjusted under 35 U.S.C. 154(b) by 0 days.

(21) Appl. No.: 16/813,088

(22) Filed: Mar. 9, 2020

Related U.S. Application Data

(62) Division of application No. 16/433,367, filed on Jun. 6, 2019, now Pat. No. 10,627,163.

(51) Int. Cl.
*F27B 3/08* (2006.01)
*H05B 7/10* (2006.01)

(52) U.S. Cl.
CPC ..... *F27B 3/085* (2013.01); *H05B 7/10* (2013.01)

(58) Field of Classification Search
CPC ..... F27B 3/085; H05B 7/10
USPC .... 373/134, 155, 88, 60, 61, 62, 63, 66, 71, 373/72, 102, 104, 116, 118, 119, 120, 373/122; 219/50, 649; 425/78, 77; 257/467, 419, 466, 522, 528, 619; 428/213, 220, 245, 332, 336, 364, 368, 428/378; 423/447.3, 445; 338/279
See application file for complete search history.

(56) References Cited

U.S. PATENT DOCUMENTS 3,567,896 A * 3/1971 Chang ..... B01J 3/06 219/50
3,670,257 A * 6/1972 McMahan ..... H01S 3/041 372/33
4,148,964 A * 4/1979 Fedoseev ..... C04B 35/5831 264/332
4,247,755 A * 1/1981 Smith, Jr. ..... B01J 3/04 219/400
4,292,276 A * 9/1981 Enomoto ..... C01B 32/97 422/199
4,366,571 A * 12/1982 Palmquist ..... C03B 5/425 373/30
4,888,242 A * 12/1989 Matsuo ..... B32B 3/28 428/408
2007/0019032 A1* 1/2007 Maekawa ..... H01L 27/1292 347/45
2007/0284259 A1* 12/2007 MacLeod ..... C25C 3/06 205/390
2014/0318312 A1* 10/2014 Deegan ..... C22B 4/005 75/10.19

* cited by examiner

*Primary Examiner* — Tu B Hoang
*Assistant Examiner* — Vy T Nguyen

(57) ABSTRACT

In a system and method for heating one or more materials, a system may comprise a constant current power supply and a furnace having a chamber for receiving the one or more materials. The furnace may comprise an insulating outer section a chamber wall, and two electrodes. Other embodiments are described and claimed.

6 Claims, 4 Drawing Sheets

SYSTEM AND METHOD FOR HEATING MATERIALS

This application is a divisional of U.S. application Ser. No. 16/433,367, filed on Jun. 6, 2019.

BACKGROUND

Methods and devices such as furnaces for heating materials have existed for thousands of years. With the increasing sophistication of electronics and other manufactured products and materials that can withstand extreme environments, has come a need for heating materials to higher and higher temperatures for processing or creating these materials such as metal alloys. For example, modern electric arc furnaces can heat their contents to 1800° C. and higher. However, these furnaces require continuous cooling for operation and extra equipment to heat their contents uniformly. Furthermore, there is considerable wear on the electrodes, which require regular replacement.

Other material processing methods require temperatures that are much higher. While plasma arc furnaces can achieve high temperatures, they are costly to build and operate. They require cooling like electric arc furnaces and a carrier gas for operation, both of which reduce their energy efficiency. Furthermore, the localized nature of the plasma are makes uniform heating difficult as well.

Therefore, there remains a need for a furnace design that can heat the materials contained therein uniformly and efficiently.

SUMMARY OF THE INVENTION

The present inventive subject matter is directed to a system and methods for heating materials. A circuit may comprise a constant current power supply electrically coupled to a furnace. By applying a current to the furnace, the temperature inside the furnace may be raised to a high enough temperature to melt or boil metals and other substances.

Further objects, features, and advantages will be apparent from the following detailed description and taking into consideration the attached drawing figures.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1:
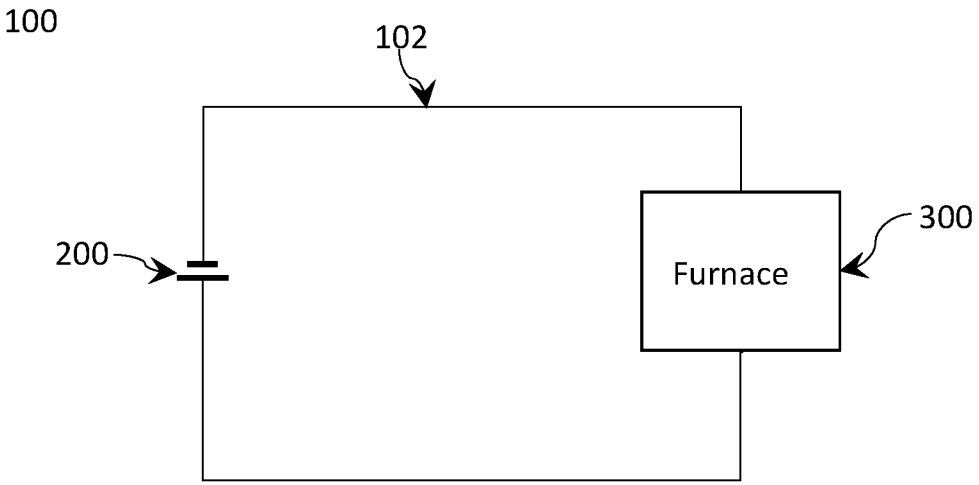
FIG. 1 is a circuit diagram of a system according to an embodiment of the invention.

It will be appreciated that for simplicity and clarity of illustration, elements shown in the drawings have not necessarily been drawn accurately or to scale. For example, the dimensions of some of the elements may be exaggerated relative to other elements for clarity or several physical components included in one functional block or element. Further, where considered appropriate, reference numerals may be repeated among the drawings to indicate corresponding or analogous elements. Moreover, some of the blocks depicted in the drawings may be combined into a single function.

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details presented herein. Furthermore, well-known features may be omitted or simplified in order not to obscure the present invention.

As described herein, a furnace is a device connected to an electric power supply to which one or more materials is delivered by batch, conveyor, or other method and having sufficient heating capacity to achieve desired temperatures for various processes. By adjusting the voltage and current of the electricity applied to the furnace, the temperature inside the furnace can be controlled and set to a specific desired level. Alternatively, such a device may also be referred to as a reactor.

The term constant current power supply is a power supply capable of producing a current of constant magnitude over a range of voltages and for which the short circuit current is sufficiently limited to avoid damage to the power supply. The current and voltage levels may be configurable for different operating conditions of the furnace. Furthermore, a constant current power supply may supply either a direct current or an alternating current depending on the configurations or embodiments of the invention. In some instances for which the power supply provides an alternating current, the frequency of the alternating current may be adjustable as well.

In a first illustrative embodiment, a system may comprise a constant current power supply electrically connected to a furnace. The furnace may comprise a chamber for receiving one or more materials to be heated, an insulating outer section or layer, a chamber wall electrically and thermally conductive for resistively heating the chamber in the presence of an electric current flowing through the chamber wall, and two electrodes electrically coupled to the constant current power supply and electrically and thermally coupled to the chamber wall. The chamber wall and the two electrodes may each have a melting temperature higher than a highest melting temperature of any substance in the material to be heated and may be capable of sustaining microplasma discharges in the presence of an electric current supplied by the constant current power supply. The constant current power supply may be capable of providing sufficient power to raise the temperature inside the chamber to a desired level.

A second illustrative embodiment may include placing a material to be heated inside a chamber of a furnace, the furnace comprising a chamber for receiving one or more materials to be heated, an insulating outer section or layer, a chamber wall electrically and thermally conductive for resistively heating the chamber in the presence of the electric current when flowing through the chamber wall, and two electrodes electrically and thermally connected to the chamber wall. The embodiment may further include supplying an electric current from a constant current power supply electrically coupled to the two electrodes of the furnace. The chamber wall and the two electrodes may each have a melting temperature higher than any substance in the material and may be capable of sustaining microplasma discharges in the presence of an electric current supplied by the constant current power supply. The constant current power supply may be capable of providing sufficient power to raise the temperature inside the chamber to a desired level.

For some preferred embodiments, if the chamber walls and electrodes of a furnace are fabricated from graphite, for example, the transmission of a high current through the electrodes and chamber walls may induce and sustain microplasma discharge formation, which will, in turn, cause resistive or Joule heating. It is an advantage of the present invention that the heat so generated may be transferred to materials inside the furnace in three ways: first by radiation through empty spaces that may exist inside the chamber, second conductively through contact between the materials and the chamber walls, and third through convection when some or all of the material inside the furnace is either in a liquid or gaseous state. Furthermore, in some embodiments for which the constant current power supply provides alternating current, the current fluctuations may generate inductive heating of any conductive materials inside the furnace.

These multiple heat transfer mechanisms and resistive heating from substantially the entire chamber wall may enable more uniform heating throughout the chamber than for other furnace technologies such as, for example, electric arc or plasma torch furnaces. Moreover, the steady current produced by the constant current power supply may eliminate variations in current density that can cause damage or erode the lifetime of certain components of other furnace technologies which may rely on constant voltage power supplies.

Changing the output current and voltage of the power supply may raise or lower the temperature reached inside the furnace as required for different processes such as for example separating metals having a diversity of melting and boiling temperatures. Variations in the design of the furnace or additional components may serve to improve other aspects of processes for which the furnace is used. For example, in some embodiments, the addition of a collection system for vaporized gas may facilitate the extraction of metals by boiling.

The power supply may allow for a smooth temperature variation, with time delay, enabling a controlled heating. This level of control may be necessary for certain uses of the present furnace such as for example the separation or extraction of precious metals from ores or other materials containing them.

FIG. 1 shows an embodiment of the present heating system. System 100 comprises a circuit 102 including a power supply 200 connected electrically to a furnace 300. Power supply 200 may, for example, comprise an alternating current constant current power supply operating at 50 to 60 Hz, although the invention is not limited in this respect. Higher operating frequencies for power supply 200 may improve microplasma discharge stability and thereby improve the uniformity of heating distribution inside furnace 300. Direct current constant current power supplies may also be employed.

In some embodiments furnace 300 may comprise a furnace for heating materials such as for example an ore that contains one or more metals, although the invention is not limited in this respect. In further embodiments, the high temperatures achievable with furnace 300 may enable formation of chemical bonds in the substances being heated, the formation of which may not be possible otherwise.

Figure 2:
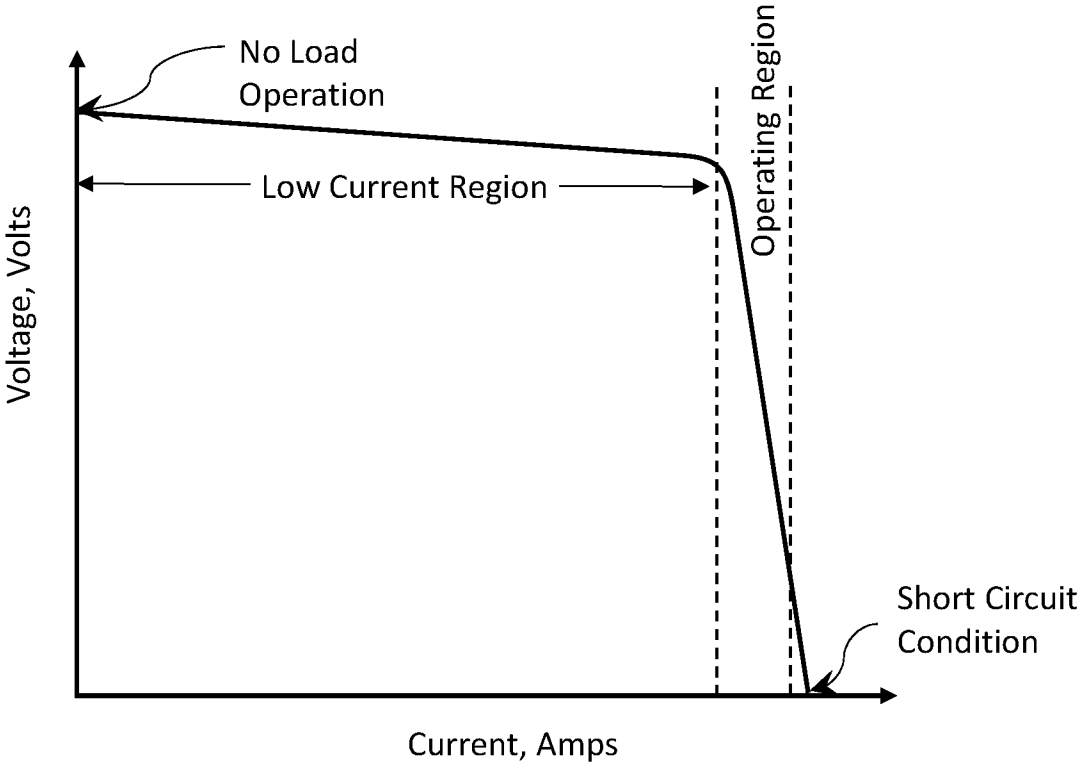
FIG. 2 is a graph showing a representative voltage-current characteristic of a constant current power supply for some embodiments of the invention.

FIG. 2 is a graph that illustrates a representative voltage current characteristic of a power supply of the same type as power supply 200 in circuit 102 according to an embodiment of the invention. This-constant current power supply provides for stable operation of the system. The shape of the voltage current curve in FIG. 2 is nearly rectangular such that for the low current region bounded on a first edge by the no-load operation voltage with no current flowing and at a second edge at which a small decrease in voltage results in a large increase in current, the voltage decreases slightly with increasing current. In the operating region, the current provided by power supply 200 is relatively constant or steady over a decreasing range of voltages from that at the second edge of the low current region to a low voltage above the zero voltage or the short circuit condition.

A feature of power supply 200 limits the short circuit current to prevent damaging the power supply. For example, in an embodiment of the present invention, the short circuit current is limited to be no more than approximately 20% higher than the current in the operating region, i.e. at a voltage at or near the short circuit voltage. Constant current power supplies with this characteristic are known in the art and are available commercially.

In some embodiments of the present invention, the voltage and current required for proper operation of the invention may vary according to the internal temperature desired: a higher temperature may require a higher operating current and operating voltage than another. In addition, the voltage and current required for proper operation of the invention may vary according to the construction, capacity, load, and function of furnace 300. Furthermore, power supply 200 may generate a constant operating high current at a relatively low operating voltage. The combination of high current and low voltage has been used previously, for example, in the production of carbon nanotubes by plasma synthesis (see Journal of Applied Physics, Volume 95, #4, Feb. 15, 2004 by Hinkov, Grand, Farhat et al.). However, that application and others have utilized electric-arc discharges between carbon electrodes as the primary heating mechanism and not formation of microplasma discharges in graphite components for resistive heating. In one embodiment of the present invention, power supply 200 may have a no-load operation voltage of 90V, maximum operating voltage of 44V, and an operating voltage range of 19.5V to 22V for an operating current of 1200 A to 1500 A at a frequency of 60 Hz. The speed of the rise in temperature inside furnace 300 and duration of power supplied by power supply 200 may be adjusted according to the requirements of the process and may, for some embodiments, be determined experimentally, empirically, or may be derived from the properties of the furnace.

Some embodiments of the present invention may utilize parallel connections of several power sources 200 to enhance current flow through the furnace or increase the frequency of an alternating current power source to provide a sudden increase in current or induction power delivery to the material processed. Such a sudden power delivery may provide a disintegration of certain materials having a brittle structure into a metal powder, which may comprise nanosized particles.

Figure 3:
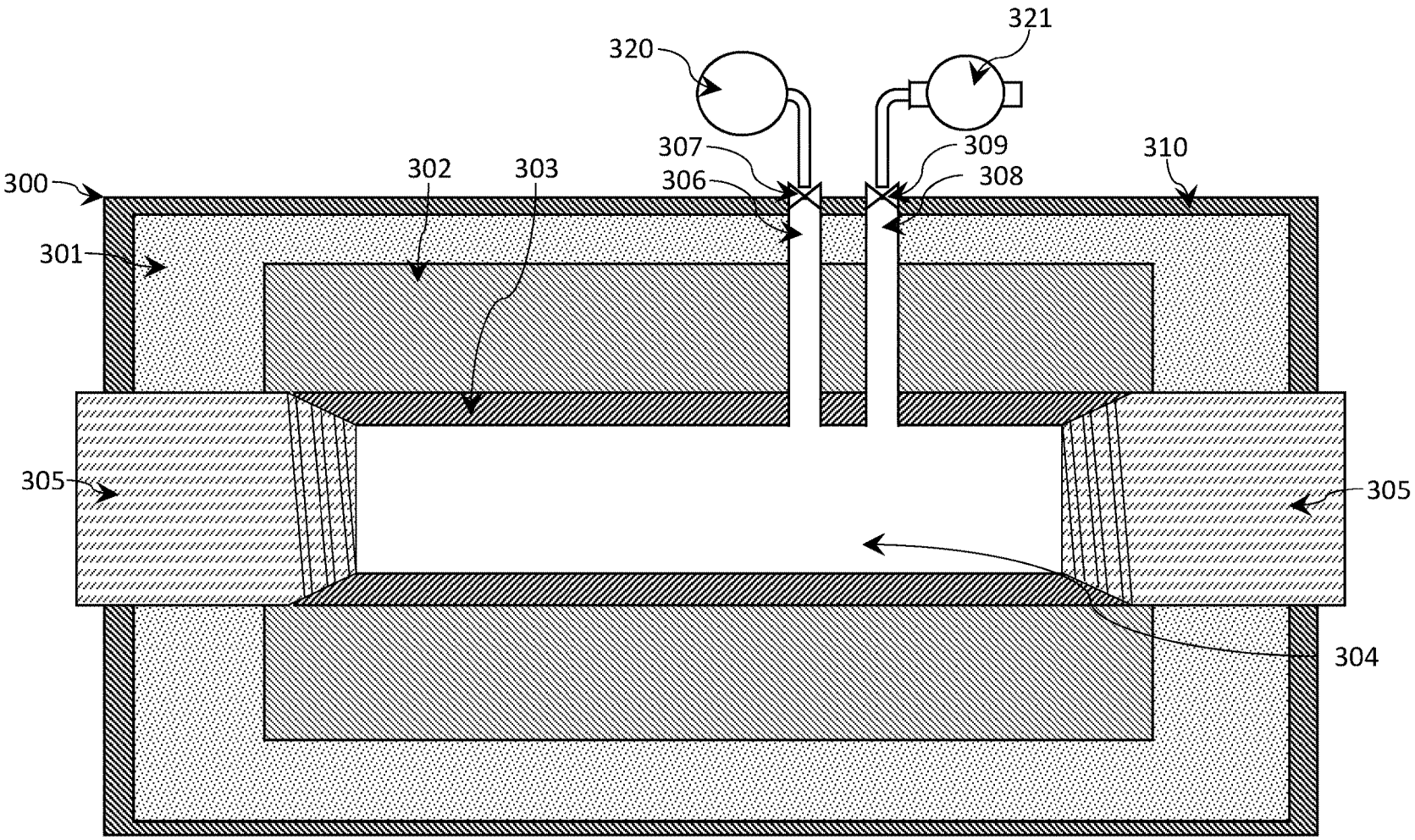
FIG. 3 shows a cross section of a furnace according to an embodiment of the invention.

FIG. 3 shows a cross-section of furnace 300 for some embodiments of the present invention. In the embodiment of FIG. 3, furnace 300 may operate to heat one or more materials to one or more desired temperatures. Furnace 300 may be comprised of an insulating outer section 301, conducting chamber wall 302, sleeve 303, furnace chamber 304, electrodes 305, inert gas supply tube 306, inert gas supply valve 307, gas discharge tube 308, and gas discharge valve 309, enclosure 310, an inert gas supply 320, and a vacuum pump 321. Additional elements may be included in furnace 300 as needed to accommodate different uses for furnace 300.

Insulating outer section 301 may surround chamber wall 302 and may function to assure enough heat retention for the desired temperature to be reached in furnace chamber 304 without undue thermal losses. Insulating outer section 301 may be comprised of one or more insulating materials that thermally insulate chamber wall 302 and furnace chamber 304 from the outside environment. In an embodiment of the present invention, zirconium silicate, chemically $ZrSiO_4$, having a melting temperature between 2100° C. and 2300° C. may be included as one of the ingredients of the insulating material. Zirconium dioxide, chemically $ZrO_2$, may also be included as an ingredient of the insulating material. In some embodiments of the present invention, the insulating material may include a mix comprising 25 to 35 percent silicon dioxide ($SiO_2$) and 75 to 65 percent zirconium dioxide respectively or in approximately a 1 to 2 ratio of silicon dioxide to zirconium dioxide along with one or more other materials such that the composition can withstand a high temperatures of 2200-2700° C., depending on relative amounts of $SiO_2$ and $ZrO_2$. Alternatively, for higher temperature applications, some embodiments of insulating outer section 301 may comprise pure zirconium powder having a melting temperature of 2700° C. Other insulating materials or devices may also be used.

Chamber wall 302 forms the shape of furnace chamber 304 according to the function of furnace 300. In a preferred embodiment, the shape of chamber 304 may be cylindrical with chamber wall 302 having an annular cylindrical shape although the invention is not limited in this respect. In another embodiment of the present invention, the shape of chamber wall 302 may define a rectangular parallelepiped. Other such shapes that allow for adequate heat retention and distribution, such as a hollow spherical shape, are also possible. To allow for placement or insertion of materials into furnace chamber 304 and removal of processed materials after operation of furnace 300, chamber wall 302 may be separable into 2 or more mated parts. Alternatively, chamber wall 302 may be a single component configured to allow materials to be physically inserted and removed from furnace chamber 304 through the orifices or apertures in which the electrodes are placed. Alternatively, chamber wall 302 may include a sealable orifice to allow for insertion of material and may include a sump or similar structure for collecting processed materials.

In some embodiments chamber wall 302 may be comprised of graphite having a uniform anisotropic structure that may have been formed by a process including isostatic pressure for compaction and or shape forming. Alternatively, chamber wall 302 may be comprised of another electrically and thermally conductive material with a melting point higher than the highest operating temperature of furnace 300 and that may support the formation of microplasma discharges internally with the application of the appropriate voltage and current to electrodes 305. For example, for a cylindrical furnace chamber 304 with a chamber wall 302 having an outer diameter of 24 mm, an inner diameter of 14 mm, a length of 500 mm, and a total graphite mass of 283.5 grams for chamber wall 302 and electrodes 305, an operating voltage of 20V and 1200 amps may induce the formation of microplasma discharges throughout chamber walls 302 and electrodes 305 thereby causing resistive or joule heating of enough magnitude to raise the temperature inside furnace chamber 304 high enough to melt at least some precious metals such as platinum having a melting temperature of 1768° C. In practice, the highest operating temperature of furnace 300 achieved by an embodiment of the invention has been at least 3422° C., determined by the successful melting of tungsten.

To prevent materials from sticking to chamber wall 302 during operation of system 100, some embodiments of the present invention may include a sleeve 303 that fits snugly inside chamber wall 302 and conforms to the shape of furnace chamber 304. Sleeve 303 may consist of a nonstick, electrically and thermally conductive material such as tungsten, for example, that prevents at least some post-processed materials such as residues or mischmetals from attaching to chamber wall 302. Sleeve 303 may also be capable of remaining in solid form when subjected to the high operating temperatures inside furnace chamber 304.

Two or more electrodes 305 may be electrically connected to power supply 200 and form a closed circuit together with chamber wall 302. Electrodes 305 may extend through enclosure 310 and insulating outer section 301 into chamber wall 302 and may seal furnace chamber 304 when so inserted. In some embodiments, the ends of electrodes 305 may be flush with the interior of chamber wall 302, alternatively in other embodiments electrodes 305 may protrude into furnace chamber 304. For embodiments in which sleeve 303 may be present, the ends of electrodes 305 that are to be inserted inside chamber wall 302 may be tapered and may include threading that may be mated to threading in sleeve 303 as in the embodiment of FIG. 3 or to chamber wall 302. Other means for fixing electrodes 305 to chamber wall 302 that can seal furnace chamber 304 and electrically connect electrodes 305 to chamber wall 302 for operations such as for example an external locking mechanism may also be employed.

In some embodiments for which furnace chamber 304 is cylindrical, electrodes 305 may be shaped as tapered cylindrical endcaps although the invention is not limited in this respect. The shape of electrodes 305 may be configured to fit a different shape for furnace chamber 304 and corresponding different shape for chamber wall 302 as appropriate. Electrodes 305 may consist of graphite as is known in the art, possibly of the same composition as chamber wall 302. Other materials that can withstand the internal temperatures of furnace chamber 304, are electrically conductive, and can sustain the formation of internal microplasma discharges may also be employed.

In some embodiments of the present invention subsequent to sealing furnace chamber 304, air inside furnace chamber 304 may be replaced or purged with an inert gas such as argon prior to operation to prevent undesirable chemical reactions such as for example oxidation, although the invention is not limited in this respect. For other embodiments, operation of the present invention may be sustainable without purging air inside the furnace chamber. Such purging to provide a non-reactive environment for melting and boiling of the desired substances and the equipment to accomplish it are well known in the art. To accomplish the replacement of air with an inert gas, inert gas supply tube 306 and gas discharge tube 308 may connected respectively to inert gas supply 320 and vacuum pump 321 as is known in the art. Supply valve 307 and discharge valve 309 may function respectively to isolate inert gas supply 320 and vacuum pump 321 respectively from furnace chamber 304 when the furnace chamber 304 is not being purged. The location, size, and shape of inert gas supply tube 306 and gas discharge tube 308 may vary according to the shape and size of furnace chamber 304. In some embodiments, inert gas supply tube 306 and gas discharge tube 308 may have a circular cross-section, thereby having a cylindrical form although the invention is not limited in this respect. Other tubular shapes are also possible. To replace or purge the air prior to operation, opening supply valve 307 may release a pressurized inert gas into furnace chamber 304. Opening discharge valve 309 may enable air to be exhausted from furnace chamber 304 by vacuum pump 321 when activated. Other purging systems as known in the art may also be employed.

Enclosure 310 may optionally surround insulating outer section 301 and may be sized to contain a sufficient quantity of insulating outer section 301 for proper operation of furnace 300 without significant radiative heat loss. Enclosure 310 may also provide additional thermal insulation. In some embodiments, the shape of enclosure 310 may conform to the shape of chamber wall 302, although the invention is not limited in this respect. For example, in one preferred embodiment having a cylindrical chamber wall 302, enclosure 310 may comprise fire-resistant bricks forming all six sides of a rectangular parallelepiped or alternatively five sides with the topside optionally open. Furthermore, in some embodiments enclosure 310 may be considered part of or may be incorporated into insulating outer section 301.

The temperature inside reaction chamber 304 may be maintained at or near an intended operating temperature for long enough duration to complete a desired process such as for example melting a substance, bonding two substances together, or separating a metal from an ore. At that time, power supply 200 may be disengaged, and furnace 300 may be allowed to cool down. The products and byproducts may then be removed for further processing. Other means for collecting one or more desired substances or products are also possible, such as for example, in a sump built into the bottom of furnace 300.

Using an embodiment of system 100, an experiment was conducted to extract iron from an ore comprising 18-22% iron. The extracted metallic material had an iron content of 97-98% as confirmed by scanning electron microscopic analysis. In this experiment, a coke, e.g. carbon, was used as a reducing agent. The current was in the range of 740-760 A and voltage was in the range of 14-8 V.

Figure 4:
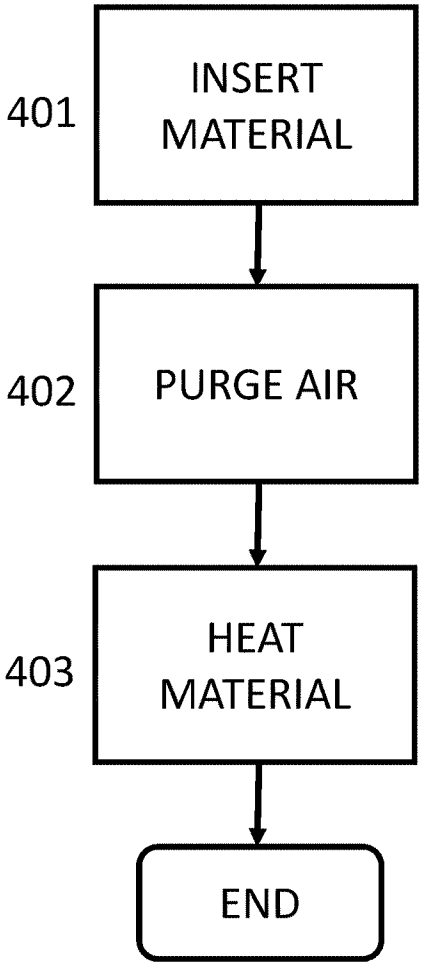
FIG. 4 is a flowchart of a method for heating one or more materials according to an embodiment of the invention.

Reference is now made to FIG. 4, which shows a method for heating one or more materials according to a preferred embodiment of the invention. Embodiments of the method may be used by, or may be implemented by, for example, system 100 employing the elements of circuit 102.

In operation 401 the material or materials to be heated may be placed in furnace chamber 304 and furnace 300 may be sealed. In some embodiments, additional substances such as for example a catalyst, a coke with high carbon content, or other substance that facilitates a chemical reaction or other process may also be placed into furnace chamber 304.

In operation 402, inert gas supply valve 307 and gas discharge valve 309 may be opened and inert gas supply 320 and vacuum pump 321 activated to allow an inert gas to enter furnace chamber 304 and replace the air inside with the inert gas. These valves are then closed for execution of the next operation. In some alternative embodiments, the presence of air in furnace chamber 304 may not significantly affect the desired process such that operation 402 may be omitted.

For operation 403, power supply 200 may be activated to apply constant current to electrodes 305. The current may flow through electrodes 305 and chamber wall 302 thereby forming microplasma discharges within electrodes 305 and chamber wall 302 and consequently heating furnace chamber 304 through resistive heating. The voltage and current settings for power supply 200, are determined by a number of different parameters including, but not limited to the intended operating temperature or temperatures, the size and shape of furnace chamber 304, and the type and amount of material to be heated. In some embodiments, the temperature inside furnace chamber 304 may be subsequently raised or lowered to a second temperature to produce a desired effect on the contents of furnace chamber 304.

Once substantially all of the desired reaction, reactions, separation, bonding or other process or processes are complete, power supply 200 is turned off and the method ends. After sufficient time for cooling, furnace 300 may be unsealed or opened, and the contents may then be physically removed from furnace chamber 304, although the invention is not limited in this respect. In some embodiments, isolation of a desired substance from a residue may occur inside furnace chamber 304 or using an attachment to furnace 300, possibly during operation 403 by means for example of a sump, condensation chamber, or other collection mechanism.

Other operations or series of operations may be used.

While the invention has been described with respect to a limited number of embodiments, it will be appreciated that many variations, modifications and other applications of the invention may be made. Embodiments of the present invention may include other apparatuses for performing the operations herein. Such apparatuses may integrate the elements discussed or may comprise alternative components to carry out the same purpose. It will be appreciated by persons skilled in the art that the appended claims are intended to cover all such modifications and changes as fall within the true spirit of the invention.

What is claimed is:

1. A method for heating one or more materials, the method comprising:

placing the one or more materials inside a chamber of a furnace, the chamber for receiving the one or more materials, and the furnace comprising an insulating outer section, a chamber wall electrically and thermally conductive for resistively heating the chamber in the presence of an electric current flowing through the chamber wall, and two electrodes electrically and thermally connected to the chamber wall, and supplying an the electric current from a constant current power supply electrically coupled to the two electrodes, the constant current power supply configured to produce a current of a constant magnitude over a range of voltage, and having a short circuit current, and for which the short circuit current is limited to avoid damage to the power supply, and further configured to provide power to achieve an operating temperature up to 3422° C. inside the chamber, wherein each of the chamber wall and the two electrodes each are comprised of graphite having a uniform anisotropic structure, the chamber wall is lined with tungsten on an inner surface of the chamber wall, the chamber wall and two electrodes are adapted to sustain microplasma discharges internally to a material of the chamber wall and two electrodes in the presence of the electric current flowing through the electrodes and the graphite chamber wall supplied by the constant current power supply.

2. The method of claim 1 wherein the furnace is further comprised of an inert gas purging system for purging air from the chamber and the method further comprises the step of purging air from the chamber prior to supplying the electric current from the constant current power supply.

3. The method of claim 2 wherein the chamber wall has an annular cylindrical shape.

4. The method of claim 3 where the constant current power supply is an alternating current constant current power supply.

5. The method of claim 4 where the insulating outer section is comprised of at least one of the following materials: zirconium silicate, zirconium dioxide, silicon dioxide, and fire-resistant bricks.

6. The method of claim 5 where the insulating outer section is comprised of a mix of silicon dioxide in a range of 25 to 35 percent and zirconium dioxide in a range of 75 to 65 percent.

* * * * *